US005705763A

United States Patent [19]

Leon

[11] Patent Number: 5,705,763

[45] Date of Patent: Jan. 6, 1998

[54] FIRE SELECTOR SYSTEM FOR SELECTING BETWEEN AUTOMATIC AND SEMI-AUTOMATIC OPERATION OF A GUN

[76] Inventor: Jorge A. Leon, Av. Macuto, Res. Macaracuay, Apto. #4B, Macaracuay Caracas, Venezuela

[21] Appl. No.: 685,184

[22] Filed: Jul. 18, 1996

[51] Int. Cl.[6] ..... F41A 19/33

[52] U.S. Cl. ..... 89/140; 89/128

[58] Field of Search ..... 89/140, 141, 142, 89/128

[56] References Cited

U.S. PATENT DOCUMENTS

| | | | |
|---|---|---|---|
| 2,216,412 | 10/1940 | Holek | 89/142 |
| 2,432,486 | 12/1947 | Patchett | 89/142 |
| 2,572,872 | 10/1951 | Ketterer | 89/140 |
| 2,718,818 | 9/1955 | Cuppini et al. | 89/142 |
| 2,909,100 | 10/1959 | Kennerley-Tayler | 89/140 |
| 3,012,479 | 12/1961 | Ruffell | 89/142 |
| 3,021,763 | 2/1962 | Beretta | 89/140 |
| 3,358,560 | 12/1967 | Ruffell | 89/142 |
| 4,539,889 | 9/1985 | Clock | 89/147 |
| 5,355,768 | 10/1994 | Felk | 89/147 |

FOREIGN PATENT DOCUMENTS

| | | | |
|---|---|---|---|
| 1148550 | 12/1957 | France | 89/140 |

OTHER PUBLICATIONS

Wooldridge, J. "The Enforcer," Popular Mechanics, Sep., 1991 pp. 39–42.

*Primary Examiner*—Stephen M. Johnson

*Attorney, Agent, or Firm*—Heslin & Rothenberg, P.C.

[57] ABSTRACT

A fire selector system for selecting between automatic and semi-automatic operation of a gun is provided. The system is mountable on a reciprocating slide of the gun and into operative relationship with the trigger bar of the gun. A member of the selector system is movable between forward and rearward longitudinal positions. The forward longitudinal position allows the member to assume an activating longitudinal position for automatic operation of the gun. The rearward longitudinal position prevents the member from assuming its activating longitudinal position, thereby effecting semi-automatic operation of the gun. The member repetitively contacts a contact area of the trigger bar as it reciprocates with a reciprocating slide of the gun during automatic operation. Further, the device is easily installed and removed from the reciprocating slide depending on user requirements.

7 Claims, 6 Drawing Sheets

FIRE SELECTOR SYSTEM FOR SELECTING BETWEEN AUTOMATIC AND SEMI-AUTOMATIC OPERATION OF A GUN

TECHNICAL FIELD

This invention relates to semi-automatic and automatic firearms. More particularly, this invention is a fire selector system for selectively converting a firearm between semi-automatic and automatic operation.

BACKGROUND OF THE INVENTION

Many firearms are sold in configurations which provide semi-automatic operation or automatic operation. However, it is often desirable to convert an existing semi-automatic firearm to an automatic firearm, without significant modification thereof.

Having made an initial investment in a semi-automatic firearm, many users are inclined not to make an additional, potentially equal investment in a related firearm which provides automatic operation.

Various mechanisms have been proposed in the prior art for effecting selection between semi-automatic and automatic operation. For example, U.S. Pat. No. 3,012,479 to L. E. Ruffell discloses an abutment opposite a recess in a sear, and movable between three positions for safe, semi-automatic, and automatic operation. However, this device does not appear to convert an existing semi-automatic gun to automatic operation. U.S. Pat. No. 2,572,872 to S. J. Ketterer discloses an attachment for converting a semi-automatic rifle to full automatic, but which is dependent on pivoting motion of a lever, triggered by forward movement of a bolt. An arm of the lever thereby rotates a sear into a hammer releasing position to effect automatic operation. This pivoting action of the retrofitted attachment requires significant, independent movement of the attachment itself during automatic operation, which is undesirable as it may lead to failures, mis-fires, etc. Further, cuts to the stock of the rifle are necessary to install the attachment.

Thus, what is required is a simple device for converting a semi-automatic firearm into an automatic firearm. It is preferable that such a device have few moving parts, be easily installed and removed from the existing semi-automatic firearm, operate in a simple manner, and be inexpensive.

SUMMARY OF THE INVENTION

The shortcomings of the prior art are overcome by the present invention, which in one aspect is a device for converting a semi-automatic gun into an automatic gun. The gun has a trigger bar, a reciprocating slide, and a longitudinal firing mechanism. The trigger bar is normally mounted below the firing mechanism and is movable into a first position in which the trigger bar engages the firing mechanism and prevents forward motion of the firing mechanism following trigger activation. Semi-automatic operation is thus effected by this engagement. The converting device includes a member mountable on the reciprocating slide of the gun and into operative relationship with the trigger bar of the gun. The member is movable into an activating longitudinal position in which contact between the member and a contact area of the trigger bar occurs to urge the trigger bar away from its first position following trigger activation. Automatic operation of the gun is thus effected by this contact.

The member may be reciprocatable by a user between forward and rearward longitudinal positions. The forward longitudinal position allows the member to assume its activating longitudinal position for automatic operation of the gun. The rearward longitudinal position prevents the member from assuming its activating longitudinal position and thereby allows the trigger bar to assume and retain its first position following trigger activation thus effecting semi-automatic operation.

The device may include a switch for longitudinally moving the member between its forward and rearward longitudinal positions.

The device reciprocates with the reciprocating slide upon its mounting thereon, and, when in its forward longitudinal position, can assume its activating longitudinal position and repetitively contact the contact area of the trigger bar during its reciprocation with the reciprocating slide. The member does not assume its activating longitudinal position and is thus isolated from the contact area of the trigger bar during its reciprocation when the member is in its rearward longitudinal position.

The member may include a tapered tip for contacting the contact area of the trigger bar, the tapered tip gradually urging the trigger bar away from its first position as the member is moved into its activating longitudinal position.

As set forth in greater detail hereinbelow, the fire selector system of the present invention can be easily installed and removed from an existing semi-automatic firearm, thus providing the option of a convertible gun or a non-convertible gun. Further, the fire selector system has very few moving parts, operates in a simple manner and is relatively inexpensive to fabricate.

BRIEF DESCRIPTION OF DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following detailed description of the preferred embodiment(s) and the accompanying drawings in which:

DETAILED DESCRIPTION OF THE PREFERRED EMBODIMENT(S)

Figure 1A:
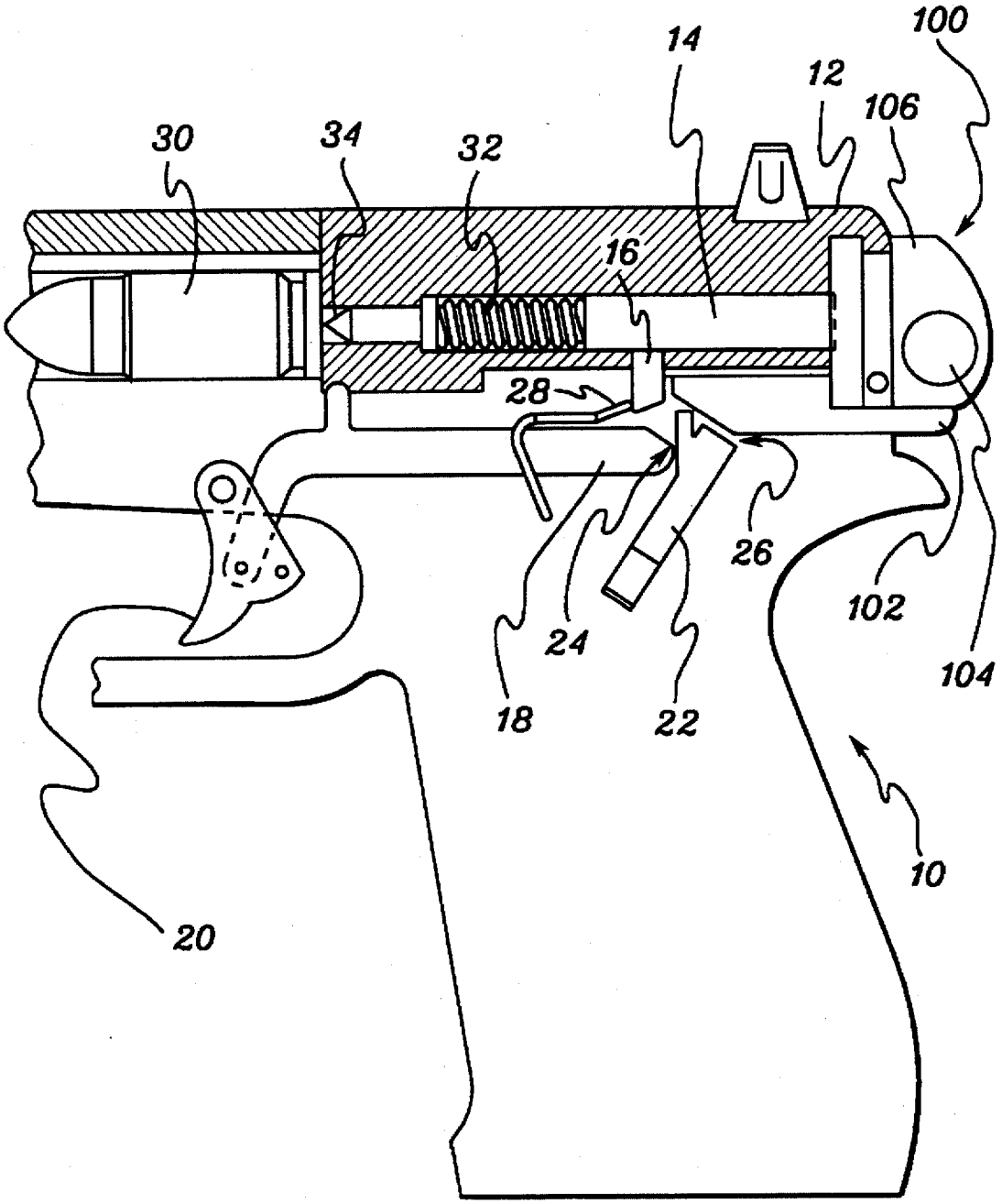
FIG. 1*a* depicts a partial cross-section of an exemplary gun having the fire selector system of the present invention mounted therein, the gun being cocked and ready to fire a single round, the fire selector system being set for semi-automatic operation.
Figure 1B:
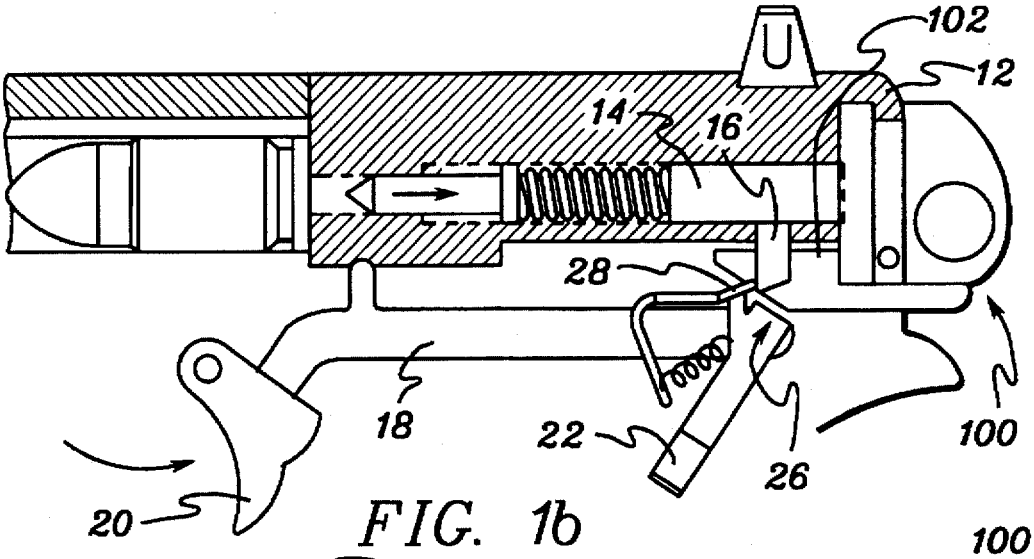
FIG. 1*b* depicts a position of the components of the gun of FIG. 1*a* at a point during a trigger activation.
Figure 1C:
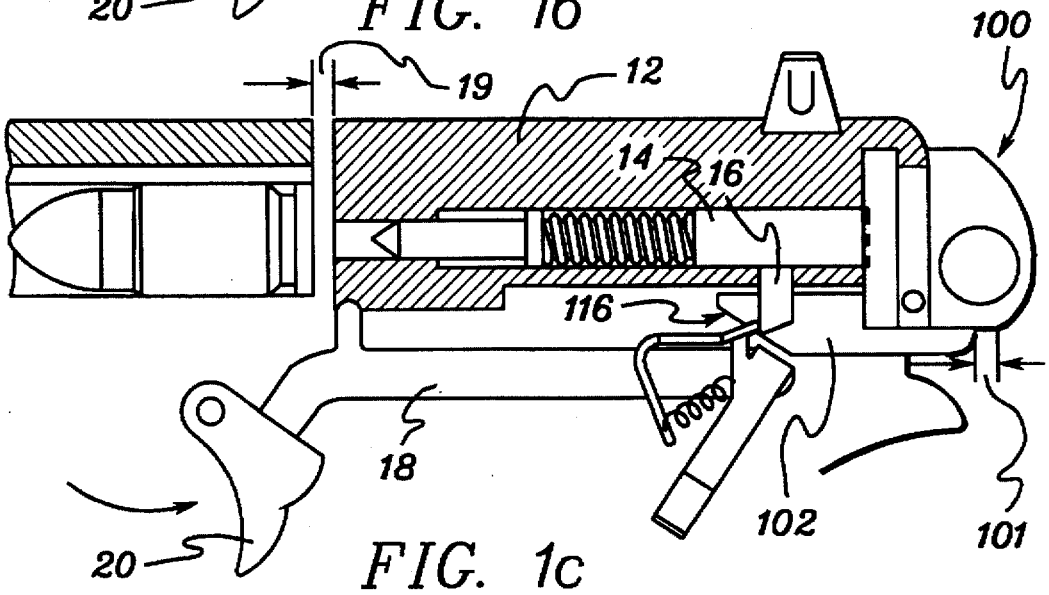
FIG. 1*c* depicts the gun having the fire selector system therein, the fire selector system being set for automatic operation, the components shown at a point following trigger activation and during forward movement of the reciprocating slide.
Figure 1D:
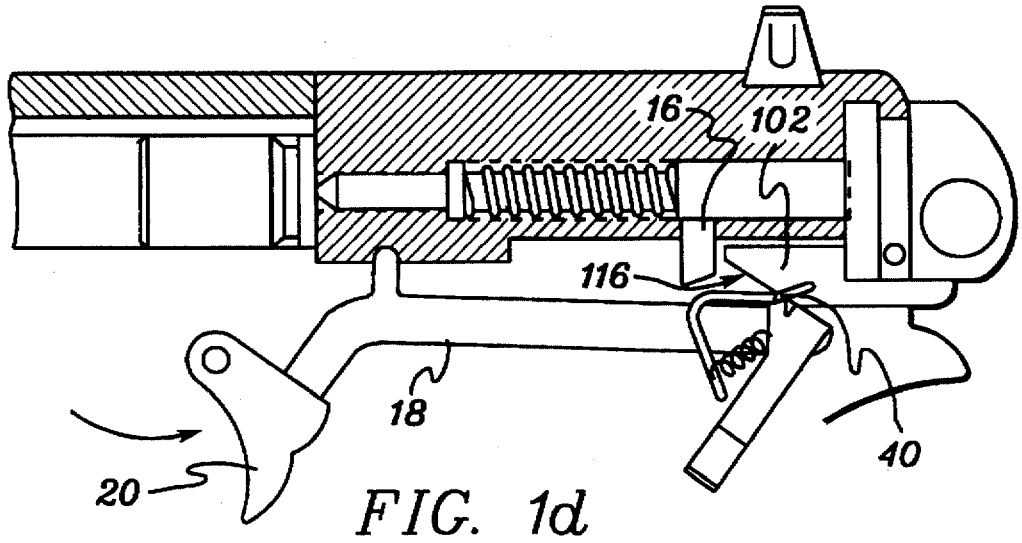
FIG. 1*d* depicts the moment of firing of the gun of FIG. 1*c;*

With reference to FIGS. 1*a–d*, depicted therein is an exemplary pistol 10 having a fire selector system 100 installed thereon, according to the principles of the present invention. FIGS. 1*a–b* depict the fire selector system in its setting for semi-automatic operation. FIGS. 1*c–d* depict the fire selector system in its setting for automatic operation.

As shown in FIG. 1*a*, the components of the gun 10 relevant to the instant invention are as follows. Trigger 20, shown in its unactivated position, is hingedly connected to a trigger bar 18. A wing 28 of trigger bar 18 is engaging a leg 16 of firing pin 14 (or mechanism). Following backward motion of the trigger, or trigger activation, trigger bar 18 moves rearward and an inclined end 24 thereof contacts an inclined control surface 26 (perpendicular to the page) of a connector 22. As end 24 reaches inclined control surface 26, the trigger bar is pushed downward such that nose 16 is released and, urged by spring 32, firing pin tip 34 will move forward, contact bullet 30, and discharge the same.

Pursuant to the principles of the present invention, a fire selector system 100 is provided on the rear of the slide 12. The system 100 has a housing 106 adapted for mounting on the slide, a switch 104 and a disconnector member 102. Disconnector 102 is movable into either a forward or rearward longitudinal position using switch 104. Disconnector 102 in FIGS. 1*a–b* is shown in its rearward longitudinal position, for semi-automatic operation. In this position, no interaction will take place between the fire selector system and the trigger bar of the gun. Therefore, as discussed above, normal semi-automatic operation will occur based on the interaction between trigger bar end 24 and control surface 26 upon activation of the trigger.

Such trigger activation is shown in FIG. 1*b*, wherein the components of the gun are shown at a moment during trigger activation. Wing 28 has pulled leg 16 backward to a point where the end 24 of trigger bar 18 (now obscured by connector 22) is beginning to contact inclined control surface 26. Upon further trigger pull, the control surface 26 will guide trigger bar 18 downward, thereby releasing leg 16 and bolt 14 and firing the gun. As discussed above, the disconnector 102 of fire selector system 100 is generally out of engagement with any of these firing components of the gun during semi-automatic operation. Thus, the gun functions in its normal, semi-automatic operation with disconnector 102 in its rearward longitudinal position. Discharge of the bullet and the subsequent backward motion of the slide 12, and release of the trigger, will effect a re-engagement of wing 28 with leg 16, in preparation for another trigger activation.

FIGS. 1*c–d* depict automatic operation of the gun, wherein the disconnector 102 of the fire selector system 100 is shown in its forward longitudinal position (i.e., moved a distance 101). FIG. 1*c* depicts forward motion of the slide following recoil from a previous trigger activation. Inclined surface 116 of the forward tip of the disconnector 102 has been moved a sufficient distance 101 forward such that contact and downward motion of the trigger bar occurs. This contact occurs at a point 19 about 1 or 2 millimeters before the slide 12 reaches its normal forward position. The firing pin 14 is thus released at this point in the reciprocation of the slide and another shot is fired without a trigger activation. Control surface 116 of the disconnector 102 contacts the trigger bar 18 to effect this firing. FIG. 1*d* depicts the moment of firing at which time the control surface 116 of the disconnector 102 has made contact approximately at a point or contact area 40 of the trigger bar. The longitudinal position at which the disconnector begins to engage the trigger bar is referred to herein as the activating longitudinal position.

As long as the trigger is pulled, and ammunition is provided in the clip, the disconnector will repetitively disengage the firing pin by repetitively engaging the trigger bar and repetitive firing will result as the selector system reciprocates with the slide.

Figure 2:
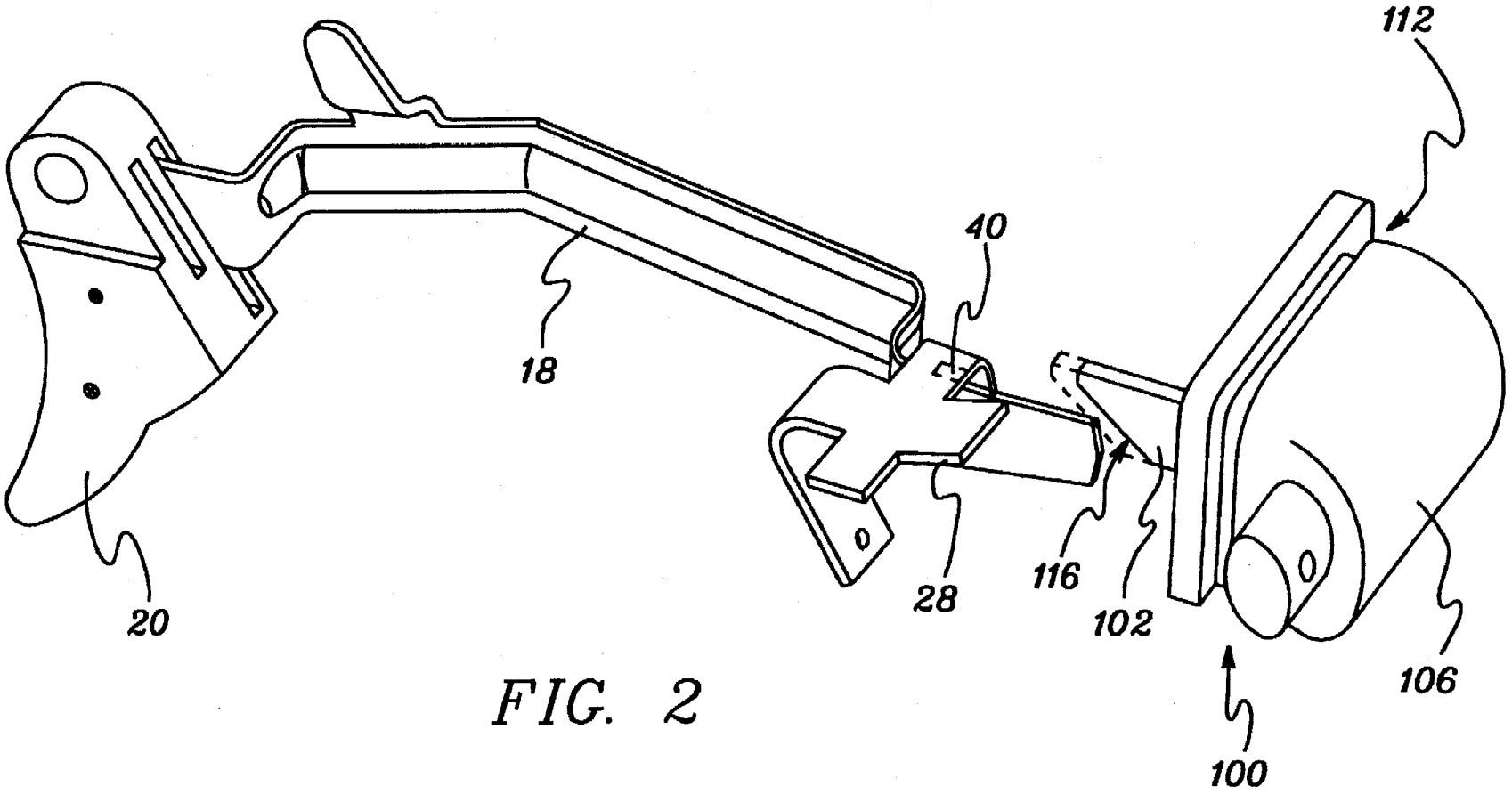
FIG. 2 is a perspective view of the trigger bar and fire selector systems of FIGS. 1*a–d*, and further illustrates the positional relationship therebetween.

FIG. 2 depicts, in perspective form, the relevant components effecting automatic operation including trigger 20, trigger bar 18 and selector system 100. The inclined control surface 116 of disconnector 102 of the selector system 100 is designed to effect contact at about contact area 40 of trigger bar 18, and gradually urge the trigger bar 18 downward as the disconnector moves forward.

Figure 3B:
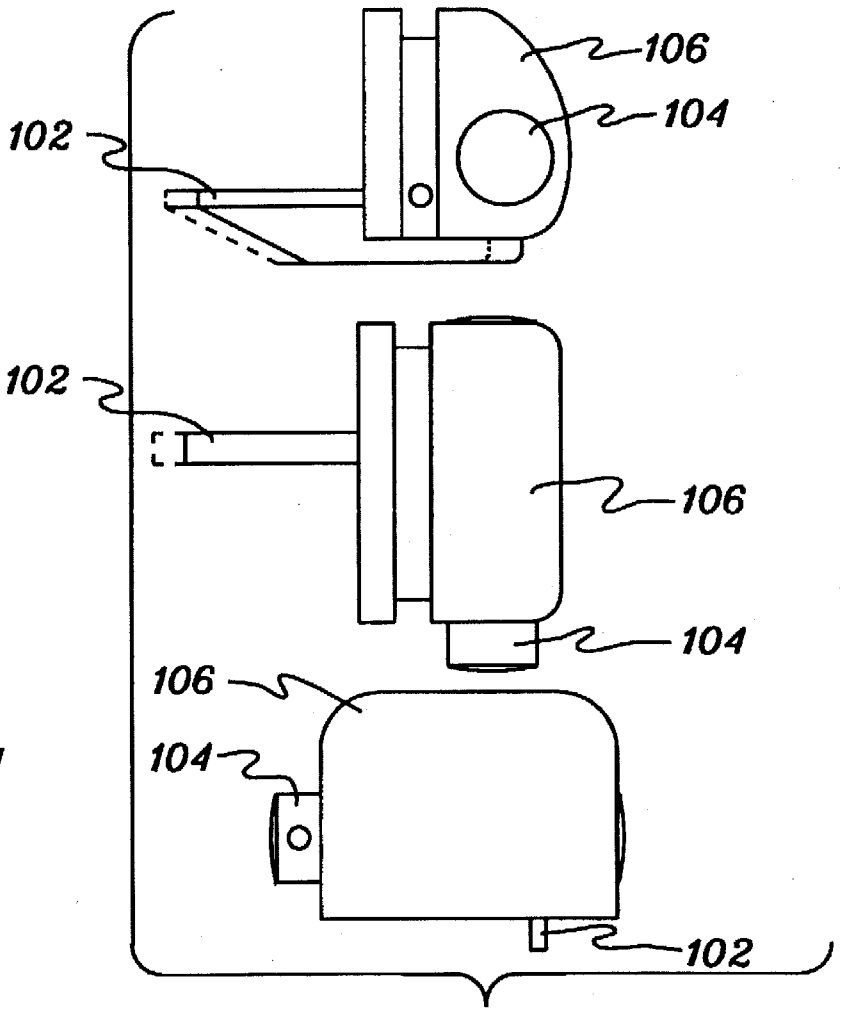
FIGS. 3*a–b* are various views of the fire selector system of the present invention in its extended (automatic) and retracted (semi-automatic) settings, respectively.
Figure 3A:
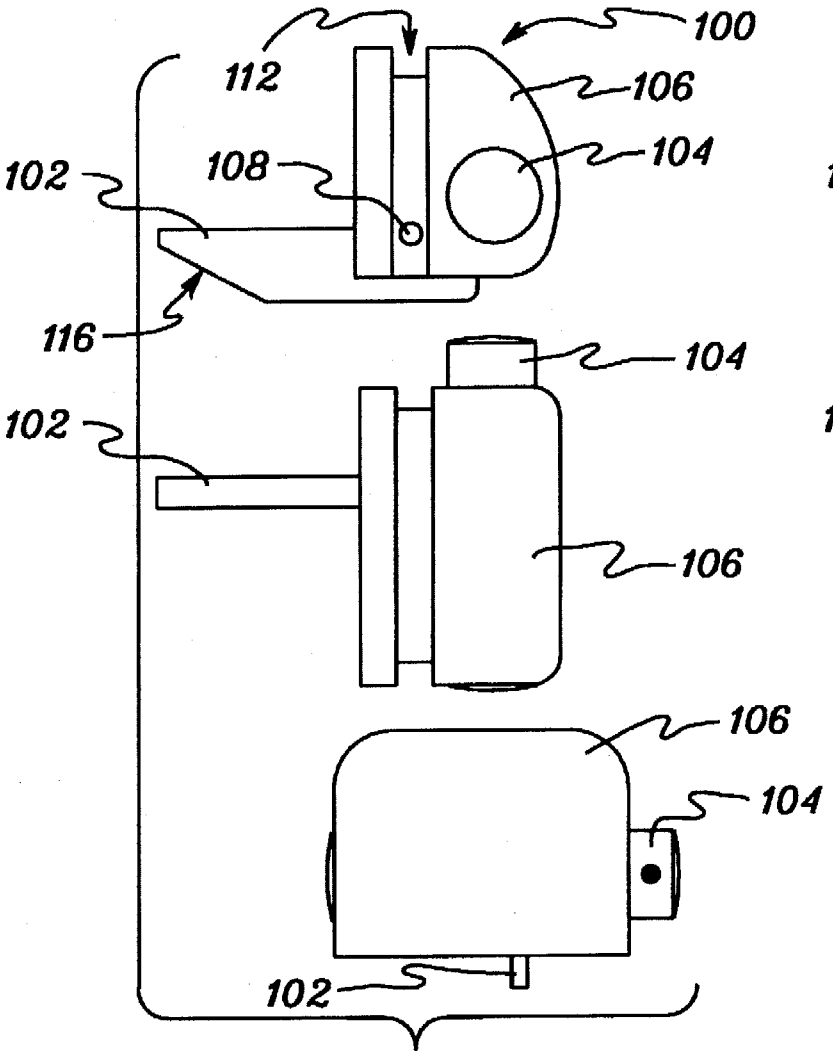

FIG. 3*a* includes side, top and rear views of the fire selector system of the present invention, with the disconnector 102 in its extended (automatic) setting. As discussed above, the components of this system 100 include a disconnector 102, housing 106 and a cylindrical switch 104 running laterally through the housing. A pin 108 can be provided to hold the disconnector 102 in housing 106. Further, the housing 106 may have a flange 112 formed thereon to effect simple installation and removal of this selector system from the gun. FIG. 3*b* depicts the same views of the selector system with the disconnector in its retracted position, using the opposite switch setting. FIGS. 3*a* and 3*b* clearly show that a first switch position effects extension of the disconnector 102 thus effecting automatic operation, and a second switch position effects retraction of the disconnector 102 thus effecting semi-automatic operation.

Figure 4B:
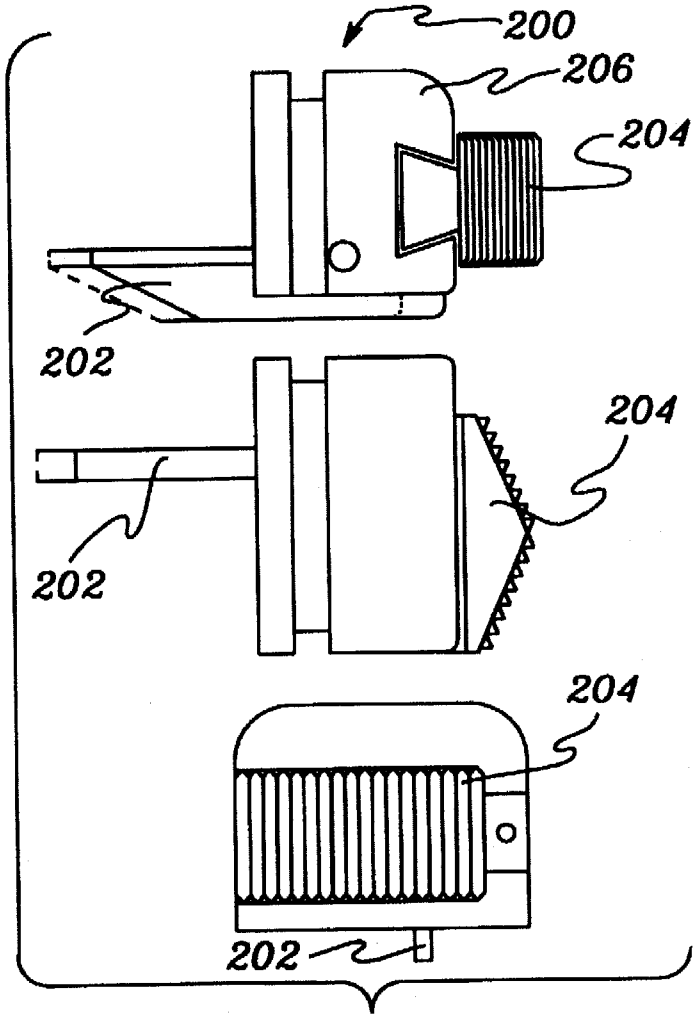
FIGS. 4*a–b* depict an alternate embodiment of the fire selector system in its extended and retracted positions, respectively.
Figure 4A:
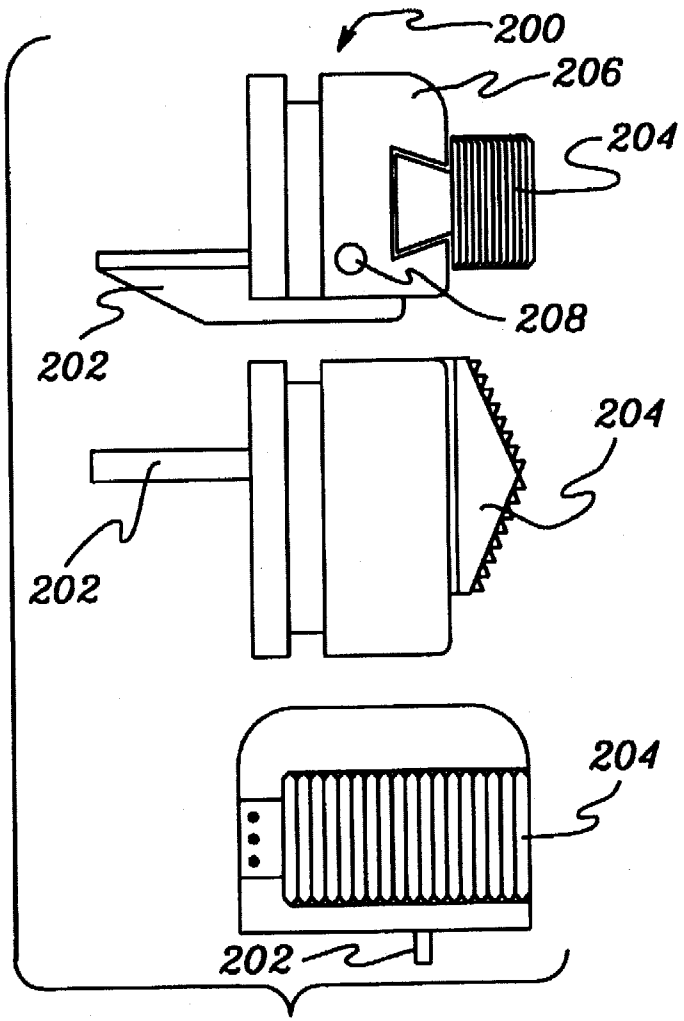

FIG. 4*a* includes side, top and rear views of an alternate embodiment 200 of a selector system pursuant to the principles of the present invention, with the disconnector in its extended (automatic) setting. Disconnector 202, housing 206 and pin 208 are similarly provided, however, a thumb switch 204 is provided in this embodiment rather than the cylindrical switch running laterally through the housing set forth in FIG. 3. FIG. 4*b* depicts the same views of the alternate embodiment 200 of the fire selector system with the disconnector in its retracted (semi-automatic) setting.

Figure 5A:
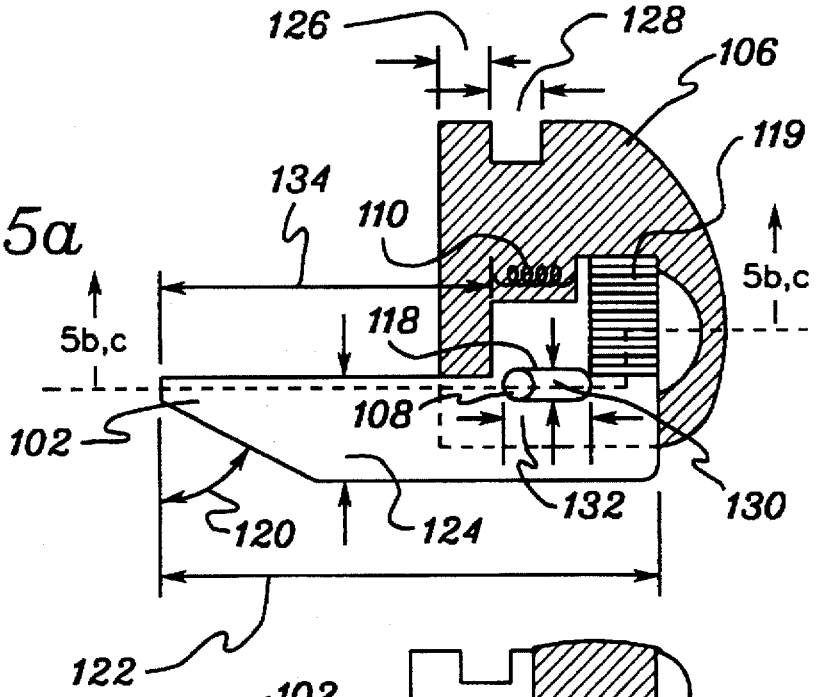
FIGS. 5*a–c* are cross-sectional views depicting additional detail of the fire selector system of FIGS. 1–3.

FIG. 5*a* is a sectional, side view of the fire selector system of FIGS. 3*a–b*, illustrating additional detail of the system. A spring 110 is shown therein which operates to urge the disconnector 102 into a rearward position. Pin 108 is shown positioned through a via 118 of the member 102. The pin is shown in front of the via indicating that the disconnector 102 is in its retracted longitudinal position. An inclined surface 119 of the disconnector 102 facilitates movement of the disconnector 102 between its retracted and extended longitudinal positions, as illustrated in the sectional, top views of FIGS. 5*b–c*, which also show a cross-section of the laterally positioned switch 104. Switch 104 includes a recess 114 into which disconnector 102 is urged by spring 110 in its retracted position. Further, a small ridge 117 is provided which, as shown in FIG. 5*c*, holds disconnector 102 in its extended longitudinal position. The inclined surface 119 of the disconnector facilitates movement into the extended position, and the inclined surfaces of ridge 117 similarly facilitate movement from the extended position into the retracted position.

Figure 5B:
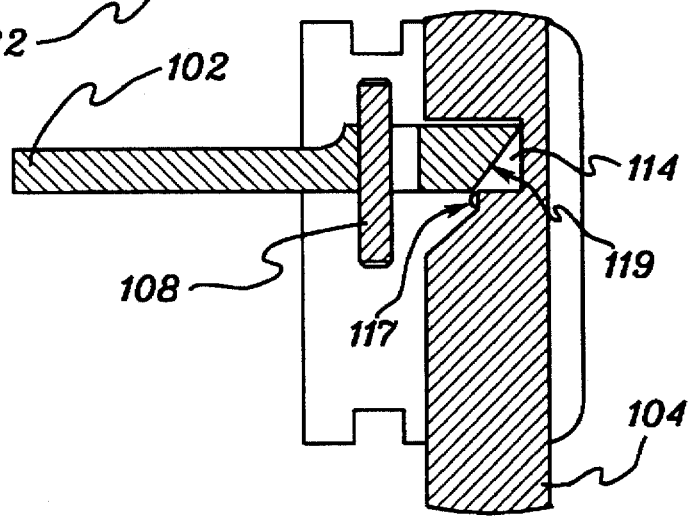
Figure 5C:
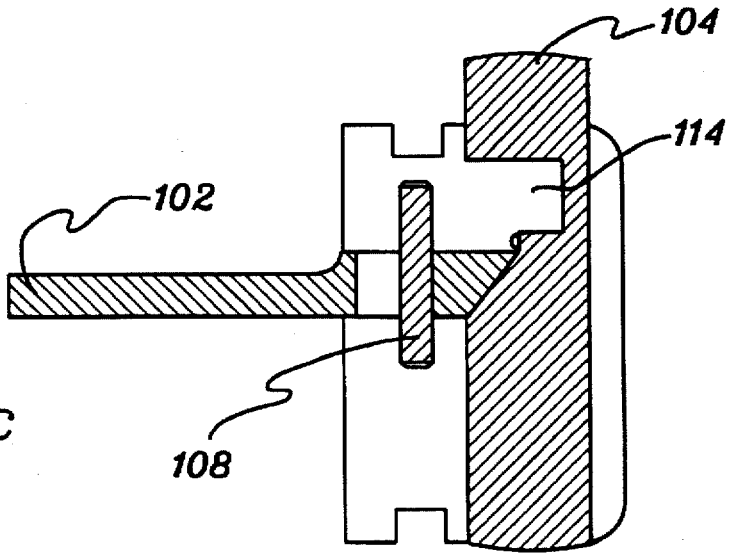

Various dimensions of the fire selector system of FIGS. 5*a–c* are set forth in the table below.

| | |
|---|---|
| 120 | 54° |
| 122 | 21.95 mm |
| 124 | 4.65 mm |
| 126 | 2 mm |
| 128 | 2.45 mm |
| 130 | 2.06 mm |
| 132 | 4.81 mm |
| 134 | 14.7 mm |

An exemplary embodiment of the fire selector system is fabricated using glass filled reinforced polymer for the switch and housing, hardened steel for the disconnector and spring, and carbon steel for the pin.

The above-described selector system therefore has few moving parts, and further is composed of relatively inexpensive parts.

Using the above-described dimensions for the housing and disconnector, a fire selector system is provided to select between semi-automatic and automatic operation of a Glock pistol of the type described in U.S. Pat. No. 4,825,744, hereby incorporated herein by reference in its entirety. The fire selector system of the present invention can be adapted to replace a slide cover plate of that pistol at the rear of the slide, and it can thus be easily installed and removed from the pistol. In its installed position, the fire selector system provides the user with a choice between semi-automatic and automatic operation; and upon its removal, the gun operates in its normal semi-automatic mode.

While the invention has been described in detail herein in accordance with certain preferred embodiments thereof, many modifications and changes therein may be affected by those skilled in the art. Accordingly, it is intended by the following claims to cover all such modifications and changes as fall within the true spirit and scope of the invention.

What is claimed is:

1. A device for converting a semi-automatic gun into an automatic gun, the gun having a trigger bar, a reciprocating slide, and a longitudinal firing mechanism, the trigger bar mounted below the firing mechanism and movable into a first position in which the trigger bar engages the firing mechanism and prevents forward motion of the firing mechanism following trigger activation, thereby effecting semi-automatic operation, the device comprising:

a member mountable on the reciprocating slide of the gun and in operative relationship with the trigger bar of the gun, the member movable into an activating longitudinal position in which contact between the member and a contact area of the trigger bar occurs to urge the trigger bar away from its first position following trigger activation thereby effecting automatic operation of the gun, wherein the member is reciprocatable between forward and rearward longitudinal positions, the forward longitudinal position allowing the member to assume its activating longitudinal position for said automatic operation of the gun, the rearward longitudinal position preventing the member from assuming its activating longitudinal position, thereby allowing the trigger bar to assume and retain its first position following trigger activation to effect said semi-automatic operation of the gun;

and wherein the device further comprises a user switch coupled for longitudinally moving the member, the user switch having a first position corresponding to the forward longitudinal position of the member and a second position corresponding to the rearward longitudinal position of the member.

2. The device of claim 1, further comprising a housing in which the member and the user switch are mounted, the housing adapted to be mountable on a rearward portion of the reciprocating slide of the gun with said member extending forward into the reciprocating slide and into the operative relationship with the trigger bar of the gun upon mounting of the housing on the rearward portion of the reciprocating slide.

3. The device of claim 2, wherein the device reciprocates with the reciprocating slide upon its mounting thereon, the member assuming its activating longitudinal position and repetitively contacting the contact area of the trigger bar during its reciprocation with the reciprocating slide when the member is moved into its forward longitudinal position, the member not assuming its activating longitudinal position and being isolated from the contact area of the trigger bar during its reciprocation with the reciprocating slide when the member is moved into its rearward longitudinal position.

4. The device of claim 1, wherein the user switch is elongate and runs laterally through the housing, and wherein the device comprises a spring for urging a rearward end of the member against a side of the user switch, the side of the user switch having a recess, such that:

in a first lateral switch position comprising said first position, the rearward end of the member is positioned outside of the recess and the member thereby assumes its forward longitudinal position, and in a second lateral switch position comprising said second position, the rearward end of the member is urged into the recess and the member thereby assumes its rearward longitudinal position.

5. A device, mountable on a rearward portion of a semi-automatic gun, for selectively converting the gun between semi-automatic and automatic operation, the device comprising:

a housing adapted to be mountable on the rearward portion of the gun; and a member extending from said housing and into the gun upon mounting of the device on the gun, the member movable between an extended longitudinal position and a retracted longitudinal position, wherein in the extended longitudinal position a forward end of the member engages a trigger bar of the gun and urges the trigger bar out of engagement with a firing mechanism of the gun following trigger activation thereby effecting said automatic operation, and in the retracted longitudinal position, the member is disengaged from the trigger bar of the gun following trigger activation, thereby effecting said semi-automatic operation;

and wherein the device further comprises a switch for moving the member between its extended and retracted longitudinal positions.

6. The device of claim 5, wherein the forward end of the member is tapered, the tapered forward end gradually urging the trigger bar out of engagement with the firing mechanism when the member is in its extended longitudinal position.

7. A gun having a device therein for facilitating selection between semi-automatic and automatic operation of the gun, the gun having a trigger bar and a firing mechanism, the trigger bar being disposed below the firing mechanism and movable into an upper position in which the trigger bar engages the firing mechanism and prevents forward motion of the firing mechanism following trigger activation to effect said semi-automatic operation, the device comprising:

a member for placement in operative relationship with the trigger bar of the gun and moveable by a user between a forward and rearward longitudinal position, the rearward longitudinal position of the member allowing the trigger bar to assume its upper position following trigger activation thereby effecting said semi-automatic operation by allowing engagement between the trigger bar and the firing mechanism, the forward longitudinal position of the member effecting contact between the device and the trigger bar and urging the trigger bar away from its upper position following trigger activation thereby effecting said automatic operation, wherein the device includes a user switch for longitudinally moving the member, the user switch having a first position corresponding to the forward longitudinal position of the member and a second position corresponding to the rearward longitudinal position of the member.

* * * * *